US005711854A

United States Patent [19]

Schiel et al.

[11] Patent Number: 5,711,854

[45] Date of Patent: Jan. 27, 1998

[54] DIMENSIONING OF ROLLS IN WIDE NIP ROLL PRESS

[75] Inventors: Christian Schiel, Heidenheim; Rainer Bentele, Friedrichshafen; Wolf Gunter Stotz, Ravensburg, all of Germany

[73] Assignee: Voith Sulzer Papiermaschinen GmbH, Germany

[21] Appl. No.: 657,803

[22] Filed: May 31, 1996

[30] Foreign Application Priority Data

Jun. 3, 1995 [DE] Germany ..... 195 20 442.5

[51] Int. Cl.[6] ..... D21F 3/04

[52] U.S. Cl. ..... 162/358.3; 100/93 RP; 100/176; 162/358.5

[58] Field of Search ..... 162/358.3, 358.5; 100/153, 155 R, 176, 93 RP

[56] References Cited

U.S. PATENT DOCUMENTS

| | | | |
|---|---|---|---|
| 3,448,683 | 6/1969 | Seanor et al. | 100/170 |
| 3,678,846 | 7/1972 | Bjorkegren | 100/155 R |
| 3,770,578 | 11/1973 | Spurrell | 162/206 |
| 3,991,669 | 11/1976 | Cumbers | 100/162 |
| 4,796,525 | 1/1989 | Schiel et al. | 100/176 |
| 5,076,891 | 12/1991 | Link et al. | 162/206 |
| 5,404,811 | 4/1995 | Schiel et al. | 162/273 |

FOREIGN PATENT DOCUMENTS

| | | |
|---|---|---|
| 0194010 | 9/1986 | European Pat. Off. . |
| 2214008 | 1/1973 | France . |
| 2155477 | 5/1973 | Germany . |
| 3738442 | 5/1989 | Germany . |

OTHER PUBLICATIONS

"Dictionary of Paper", American Pulp and Paper Association, 1965.

*Primary Examiner*—Karen M. Hastings

*Attorney, Agent, or Firm*—Ostrolenk, Faber, Gerb & Soffen, LLP

[57] ABSTRACT

A roll press including at least two rolls forming a press nip for the treatment of a web of material. A press roll includes a very flexible roll shell which is rotatable around a stationary support. The roll shell is mounted by at least one support element on the support. The support element has a concave support surface which forms a wide press nip with the backing roll. This provides a roll press which, even in the case of a backing roll which is without sag control, defines a press nip which is very substantially uniform. This is achieved by having the outer circumference of the shell of the press roll change in dimension in the axial direction from the axial center of the roll towards the ends of the roll, i.e., the outer circumference may increase or decrease. The circumference of the backing roll may or may not correspondingly change in the axial direction.

7 Claims, 3 Drawing Sheets

DIMENSIONING OF ROLLS IN WIDE NIP ROLL PRESS

BACKGROUND OF THE INVENTION

The present invention relates to a roll press comprising at least two rolls which form a wide or extended press nip, such as a press used for instance in the dewatering or smoothing of a fiber web, particularly a paper web. The invention particularly relates to dimensioning the flexible roll shell of the press roll in the axial direction in order to maintain a nip and additionally relates to dimensioning the backing roll which cooperates with the press roll shell.

Such press rolls are known, inter alia, from Federal Republic of Germany OS 43 22 876, which corresponds to Canadian Patent No. 2,127,767, in which the slide shoe supporting the flexible roll shell is divided into sections in the direction of travel of the web, i.e. the circumferential direction, in order to control the result of the smoothing. WO 93/12290 which corresponds to U.S. Pat. No. 5,385,088 is concerned with holding the axes of the rolls precisely in the pressing plane.

Particularly with very wide roll presses and especially with backing rolls which are not sag controlled to counter the sagging of the backing roll that occurs when that roll is pressed upon, problems may arise with respect to forming a press nip which is as uniform as possible. With very low pressing forces, the press roll can no longer fully follow the sag of the backing roll which is caused by the weight of the backing roll. This causes unequal distribution of the line force over the width of the web.

However, even if the backing roll cooperates with a third roll that supports the backing roll, as shown in WO 93/12289, which corresponds to U.S. Pat. No. 5,404,811, difficulties can arise in forming the straightest possible uniform press nip due to the sag of the backing roll.

It is possible to also support the backing roll in a controlled manner in the pressing plane, but this requires considerable expense. For example, hydraulic support which is variable across the backing roll could be used. Furthermore, thermal problems can arise in connection with support elements for the backing roll, which are generally hydraulic, if for instance, the backing roll and/or the third roll is heated to improve web dewatering or smoothing.

SUMMARY OF THE INVENTION

The object of the present invention is to provide a roll press which makes possible a press nip which is as uniform as possible even when cooperating with a backing roll without sag control.

A further object of the invention is to provide uniform pressing in a three roll press device having two press nips.

In accordance with the invention, this object can be achieved by selecting and changing the dimension of the circumference of the shell of the press roll along the axial direction from the center of the roll to its axial ends.

The outer circumference of the shell of the press roll varies in dimension from the center of the roll axially toward the ends of the roll in a manner which is dependent on the specific use. This enables a very uniform press nip to be formed even with a backing roll which is not sag controlled.

The change of the outer circumference of the shell of the press roll in the axial direction should be as small as possible and should take place uniformly so that the differences in circumferential speed along the axial length of the roll shell viewed in the axial direction do not have a negative effect on the web.

In order that there be no differences in circumferential speed between the shells of the press and backing rolls, it is advantageous if the circumference of the shell of the backing roll changes, starting from the center of the roll and extending in the axial direction to the ends of the roll, in the same manner as the press roll and preferably to the same relative extent. Therefore, both of the backing and press rolls gradually decrease in circumference to the same extent in the axial directions (decreasing circumference defining a crowned roll), so that their circumferential speeds decrease to the same extent in the axial directions, avoiding an undesired speed differential. But this size change relationship is not required, so that the circumference of one roll need not change corresponding to the change in circumference of the other roll.

The outer circumference of the roll shell, or the change thereof in the axial direction, can be controlled already at the time of manufacture in that the inner circumferences and/or the wall thickness of the shell of the press roll changes in dimension starting from the center of the roll and extending axially outward toward the ends of the roll.

Supplementing this, or by itself alone, it is, however, possible to change the circumference by thermal action on the roll shell. This can be effected from the inside, for instance by heating the lubricating fluid of the supporting elements, and/or from the outside, for instance inductively or by hot air.

Other features and advantages of the present invention will become apparent from the following description of the invention which refers to the accompanying drawings.

DESCRIPTION OF PREFERRED EMBODIMENTS OF THE INVENTION

Figure 1:
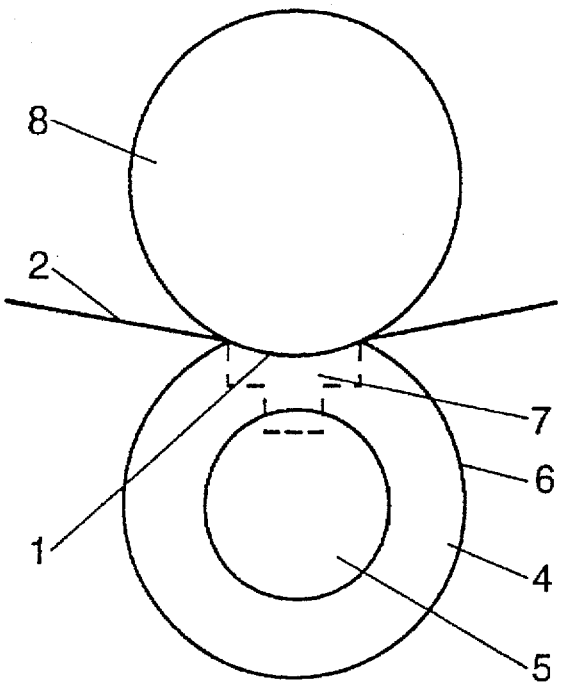
FIG. 1 is a diagrammatic cross section through a roll press having two rolls.

The roll press shown in FIG. 1 includes a press roll 4 and a backing roll 8 arranged above the press roll. This design may be used with all of the embodiments of FIGS. 3–6. In this roll press, the backing roll 8 is a rotatable solid roll, and the press roll 4 includes a very flexible roll shell 6 which is rotatable around a stationary support 5. The shell 6 is supported on the support 5, for instance via a plurality of support elements 7 arranged axially closely alongside each other. The support elements 7 are themselves hydraulically supported and can be developed so as to be controlled independently of each other in known manner. Lubrication of the slot between the support surface of the support elements 7 and the inside of the roll shell 6 can be effected hydrodynamically and/or hydrostatically. The support surface of the support elements 7 is concave to form a wide or extended press nip 1 which is used, for instance, for smoothing a fiber web, between the press roll 4 and the cylindrical backing roll 8. Such extended nip press rolls have been used for many years.

If, for example, the desired pressing force in the press nip 1 is substantially greater than the weight of the backing roll 8, a very uniform press nip can be obtained, in accordance with the invention, by decreasing the outer circumference of the shell 6 of the press roll 4 axially from the center of the roll toward the ends of the roll. All of the embodiments of FIGS. 3–5 accomplish this.

In the opposite case, if the desired pressing force is substantially less than the weight of the backing roll, it is advantageous if the outer circumference of the roll shell 6 increases from the center of the roll axially toward the ends of the roll. This may be accomplished as in FIG. 6.

In order that the change in dimension of the circumferences of the rolls remain limited so that there are no great differences in speed between the press roll 4 and the backing roll 8 in the press nip 1, it is advantageous for the circumference of the shell of the backing roll 8 to change in the axial direction, starting from the center of the roll axially to the ends of the roll, in the same manner as the shell 6 of the press roll 4 and preferably relatively to the same extent. Both circumferences decrease or increase together so that the surface speeds of the two rolls are at least approximately equal at various points along the press nip.

FIGS. 3–6 show various arrangements where the circumference of at least one of the press and backing rolls changes in the axial direction and may change relative to the circumference of the other of the two rolls. The drawings show the condition where the rolls are under pressure, and the press roll 4 is applying pressure to the backing roll 8, so that the circumferences of the rolls are in contact axially over the length of the roll and at least one of the two rolls, typically the flexible press jacket of the press roll, is deformed to conform to the stiffer roll jacket of the backing roll.

Figure 3:
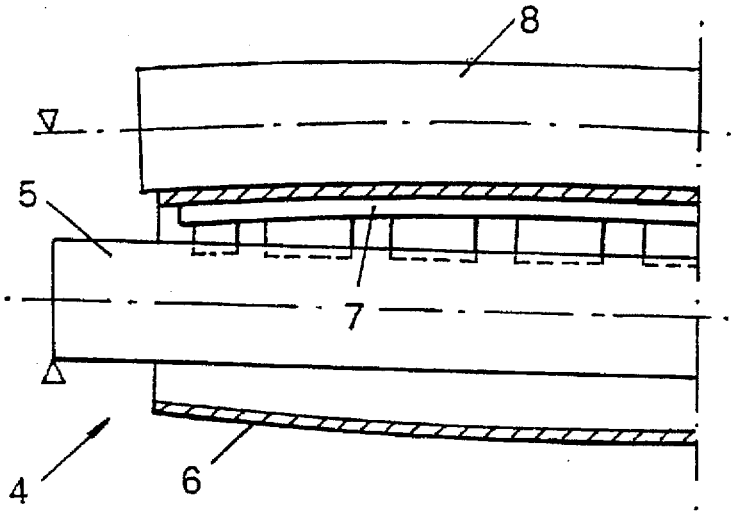
FIG. 3 is a longitudinal section through a two roll press of one embodiment.

Referring first to the embodiment in FIG. 3, the outer diameter and the outer circumference of the backing roll 8 remain constant in the axial direction from the middle to the end of that roll. The diameter adjustment and circumference change are made in the roll shell of the press roll. The outer diameter and circumference of the roll shell 6 become gradually smaller in the axial direction from the middle to the end of the press roll 4. In this embodiment also, the inner diameter of the jacket 6 becomes correspondingly smaller and the thickness of the jacket 6 remains constant.

Figure 4:
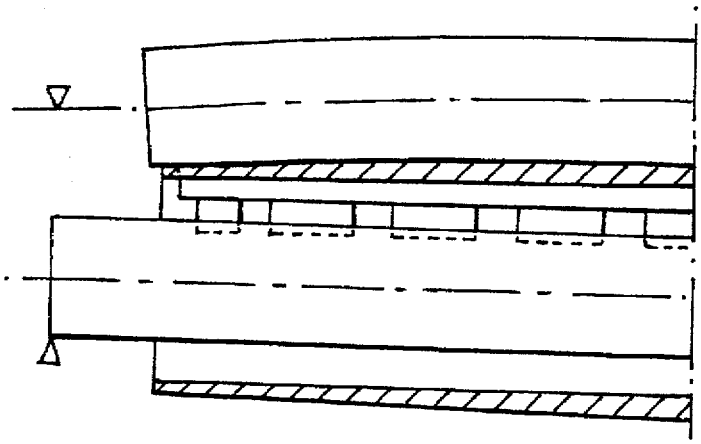
FIG. 4 is a longitudinal section through a two roll press of a second embodiment.

In the embodiment of FIG. 4, the outer diameter and circumference of the backing roll 8 remain constant in the axial direction from the middle to the end of the roll. Again, the dimensions of the press jacket 6 change, wherein its outer diameter and outer circumference become smaller in the axial direction from the middle to the end of the roll. The thickness of the press jacket 6 decreases from the middle to the end of the roll while the inner diameter or inner circumference of the press jacket remains constant, whereby the decrease in the circumference of the press jacket is achieved by thinning of the radial direction thickness of the press jacket along the axial direction.

Figure 5:
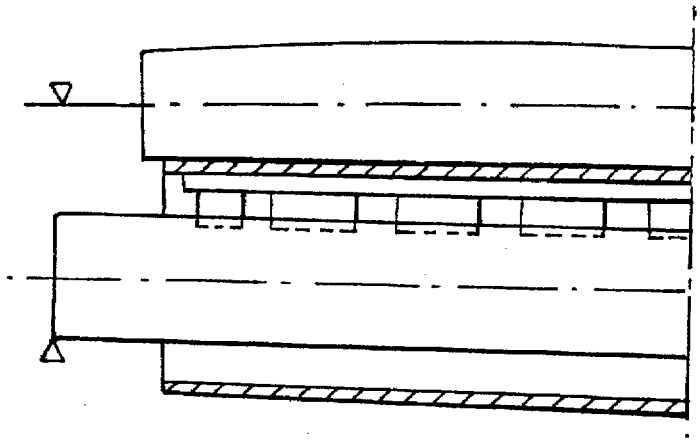
FIG. 5 is a longitudinal section through a two roll press of a third embodiment.

In the embodiment of FIG. 5, in contrast with the other embodiments, the outer diameter and outer circumference of the backing roll 8 decrease in the axial direction from the middle to the end of that roll. In addition, as in the embodiment of FIG. 3, the outer and inner diameters and circumferences of the press jacket 6 gradually become smaller while the thickness of the press jacket 6 remains constant. Since the circumferences of both the roll shell of the backing roll and the press jacket of the press roll decrease in the axial direction, the extent of the circumferential decrease of the press jacket is less than in the embodiments of FIGS. 3 and 4. Also, a speed differential between the surfaces of these rolls in the nip is diminished, reducing or avoiding rubbing due to speed differentials at the surfaces of changing circumference.

Figure 6:
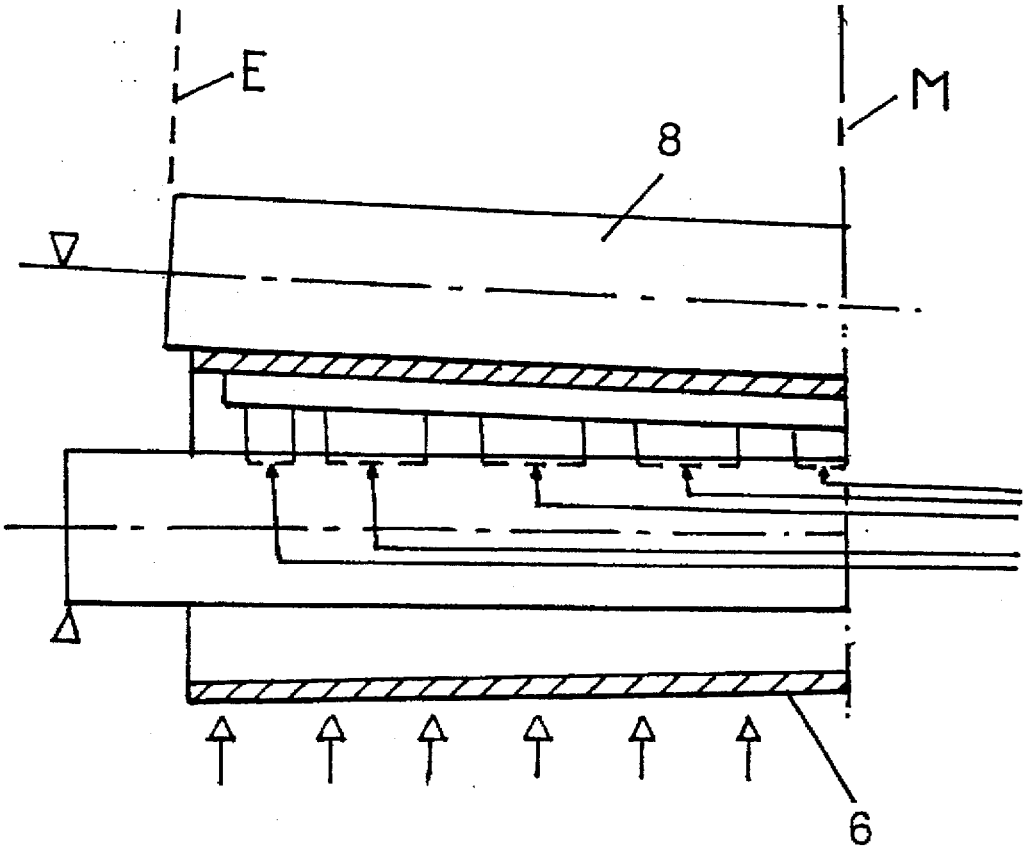
FIG. 6 is a longitudinal section through a two roll press of a fourth embodiment.

FIG. 6 shows several features of interest. The outer diameter and outer circumference of the backing roll remain constant. In contrast with the other embodiments, both the outer and inner diameters and circumferences of the press jacket increase in the axial direction from the middle to the end of the press roll while the thickness of the press jacket remains constant. Hence, there is the possibility of increasing or decreasing the outer circumference of the press roll, with the increase in circumference producing greater surface speed while the decrease produces reduced surface speed at the outer circumference and in the nip between the rolls.

The mix of increasing and decreasing diameters and circumferences illustrated in FIGS. 3–6 can be modified and mixed in other ways, with both rolls increasing, both rolls decreasing, or one roll increasing while the other decreases, as a particular application requires.

While the diameters and circumferences of the press roll jacket and sometimes the backing roll are changed by changing those dimensions, those dimensions, particularly of the thin annular press jacket, can be changed where desired by thermal action on the press roll, wherein application of heat typically would cause expansion and a circumference increase, although thermal action would not necessarily be limited to the application of heat.

The embodiment of FIG. 6 suggests two different, not necessarily mutually exclusive ways of achieving thermal action. The first way is supplying jets of hot (or cooled) air at different temperatures blown at the exterior of the press jacket, with the airjet temperatures selected to achieve a desired change in circumference of the press jacket.

The alternate technique illustrated in FIG. 6 acts on the interior of the press jacket. The support elements 7 for the press jacket of the press roll are supplied with lubricant at their slot with the interior of the press jacket so that the press jacket easily slides as it rotates past the support elements. That supply of lubricant can be temperature adjusted along the length of the press roll. Alternately, the support elements 7 comprise a plurality of individual pressurized chambers arrayed at separated locations along the stationary beam 5. Each of those support element chambers is supplied with pressurized liquid which supplies the desired press force to the press shoe and the press jacket above it and at the backing roll. Those individual pressure supplies, illustrated by the arrows thereto in FIG. 6, can be supplied with pressure liquid at different temperatures, which would eventually be transmitted to different locations along the press jacket 6 producing local thermal action at the inside of the press jacket.

Figure 2:
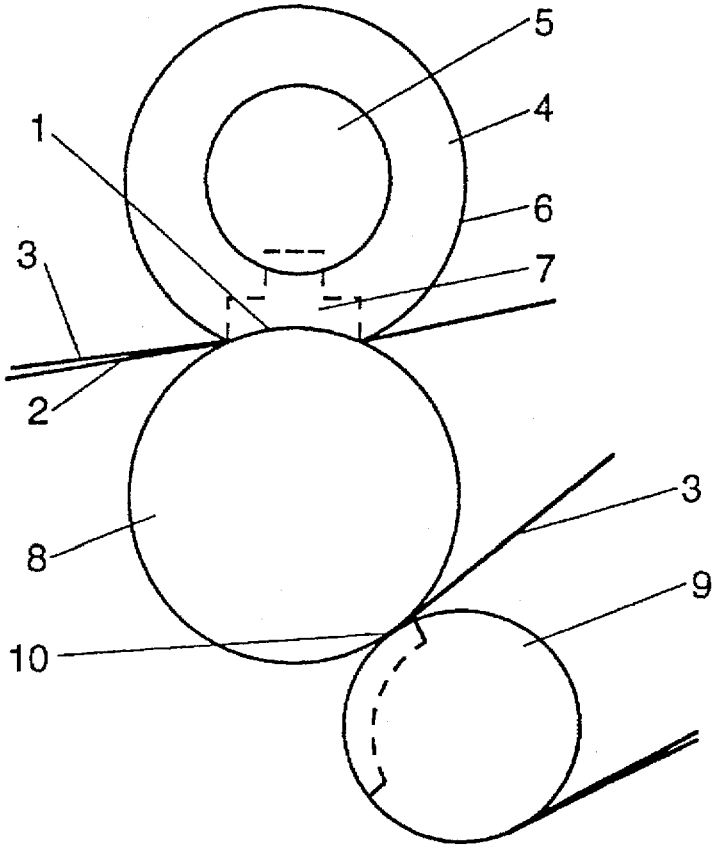
FIG. 2 is a diagrammatic cross section through a different design of roll press having three rolls.

The roll press of FIG. 2, differing from FIG. 1 and FIGS. 3–6, includes three rolls arranged approximately one above the other. The backing roll 8 is between the press roll 4 and the additional roll 9 so that the backing roll forms press nips 1 and 10, respectively, with the other rolls. The press roll 4 and the backing roll 8 are in this case of the same construction as in the first embodiment. The third roll below the backing roll 8 is developed as a suction roll 9. A separate dewatering belt 3 passes alongside the web of material 2 through the press nip. Such a roll press can be used, for instance, for dewatering a fiber web. Then it is possible to conduct a dewatering belt 3, for instance, through both press nips 1 and 10, or to use only one ledge shaped support element 7 instead of a plurality of support elements 7. The ledge shaped support element 7 may be supported by one hydraulic cushion or by a plurality of support elements, as shown in FIG. 3.

If the outer circumference of the shell 6 of the press roll 4 decreases in size from the center of the roll axially toward the ends of the roll, this has the above indicated advantage with respect to the press nip 1 between the mating backing roll and the press roll 4. The cooperation of the backing roll 8 with the suction roll 9 causes better uniformity of the press nip 10. This results from the fact that the backing roll 8 is bent axially in its center region to an increased extent toward the suction roll 9. This provides a further improvement if, for instance, the shell of the backing roll 8, and possibly even the shell of the suction roll 9, decreases from the center of the roll towards the ends of the roll. The change in circumference generally takes place symmetrically with respect to the center of the roll.

In all of the embodiments herein, sag control for the backing roll can be dispensed with. The circumference of the shell 6 of the press roll 4 can be controlled so that the inner circumference and/or the wall thickness of the shell 6 of the press roll 4 changes in dimension, starting from the center of the roll in the axial directions toward the ends of the roll.

However, it is also possible to change the circumference of the roll shell 6 of the press roll 4 entirely, or at least in part, by thermal action on the roll shell 6. This can be effected from the inside and/or the outside, for instance, by means of hot air blown on the roll shell, by inductive heating or via heating the lubricating fluid of the support elements 7.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A roll press for treating a web of material, comprising:

at least two rolls forming a press nip and including a press roll and a backing roll, the press roll comprising a stationary roll shell support, a flexible roll shell which is rotatable around the stationary support, at least one support element mounting the shell on the support, the support element having a concave support surface, for forming a wide press nip with the backing roll;

the outer circumference of the shell of the press roll changing in dimension in the axial direction from the center of the press roll toward the ends of the press roll; and further wherein:

the backing roll includes a second roll shell with a circumference that changes in dimension in the axial direction from the center of the backing roll toward the ends of the backing roll, the circumference of the backing roll second shell changing in the same manner as the press roll shell;

the wall thickness of the shell of the press roll changing in dimension from the center of the press roll in the axial direction toward the ends of the press roll; and the outer circumference of the press roll decreasing in the axial direction from the center of the roll to the ends of the press roll.

2. The roll press of claim 1, wherein the circumference of the backing roll second shell changes to the same extent as the press roll shell.

3. A roll press according to claim 1, wherein the press roll shell is such that the circumference of the shell of the press roll is changeable by thermal action on the roll shell.

4. The roll press of claim 1, wherein the inner circumference of the shell of the press roll changes in dimension from the center of the roll in axial direction toward the ends of the roll.

5. The roll press of claim 4, further comprising means for supplying thermal action on the shell of the press roll from the inside.

6. The roll press of claim 4, further comprising means for supplying thermal action on the shell of the press roll from the outside.

7. The roll press of claim 1, further comprising a further roll pressing on the backing roll on the side of the backing roll away from the nip with the press roll shell.

* * * * *